US009701134B2

(12) United States Patent
Hamada

(10) Patent No.: US 9,701,134 B2
(45) Date of Patent: Jul. 11, 2017

(54) MEDIUM SUPPORTING UNIT AND RECORDING APPARATUS

(71) Applicant: SEIKO EPSON CORPORATION, Tokyo (JP)

(72) Inventor: Nobuhiko Hamada, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/014,080

(22) Filed: Feb. 3, 2016

(65) Prior Publication Data

US 2016/0243851 A1 Aug. 25, 2016

(30) Foreign Application Priority Data

Feb. 23, 2015 (JP) ..... 2015-032782

(51) Int. Cl.
*B41J 3/407* (2006.01)
*B41J 11/06* (2006.01)

(52) U.S. Cl.
CPC ..... *B41J 3/4078* (2013.01); *B41J 11/06* (2013.01)

(58) Field of Classification Search
CPC ..... B41J 11/06; B41J 3/4078; B41F 15/18; B41F 17/005
See application file for complete search history.

(56) References Cited

U.S. PATENT DOCUMENTS 6,908,190 B2 * 6/2005 Iwatsuki ..... B41J 11/06 101/474
9,073,369 B2 * 7/2015 Yanagishita ..... B41J 15/16
2002/0060728 A1 * 5/2002 Koizumi ..... B41J 2/2114 347/101
2004/0179047 A1 * 9/2004 Niimi ..... B41J 3/28 347/4
2004/0189776 A1 9/2004 Niimi et al.
2012/0236100 A1 * 9/2012 Toya ..... B41J 11/0085 347/104

(Continued)

FOREIGN PATENT DOCUMENTS

JP 2004-291430 A 10/2004
JP 2004-291461 A 10/2004

(Continued)

OTHER PUBLICATIONS

European Search Report for Application No. 16156906.6 dated Jul. 15, 2016.

*Primary Examiner* — Stephen Meier
*Assistant Examiner* — John P Zimmerman
(74) *Attorney, Agent, or Firm* — Workman Nydegger

(57) ABSTRACT

A medium supporting unit includes a supporting portion that includes a first surface supporting a medium, a second surface recessed more than the first surface, and a first side surface connecting the first surface to the second surface, and a pressing portion that includes a pressing surface pressing the medium supported by the first surface at a position facing the second surface, and a facing side surface which faces the first side surface, in which in the supporting portion and the pressing portion, at the time of a holding state in which the medium is supported by the first surface and is pressed by the pressing surface, a part of the medium positioned between the first side surface and the facing side surface is capable of being held in a state of being separated from the second surface.

12 Claims, 8 Drawing Sheets

(56) References Cited

U.S. PATENT DOCUMENTS

| | | | |
|---|---|---|---|
| 2013/0104762 | A1 | 5/2013 | Yanagishita |
| 2013/0278697 | A1 | 10/2013 | Takeuchi et al. |
| 2013/0340640 | A1 | 12/2013 | Yanagishita |

FOREIGN PATENT DOCUMENTS

| | | |
|---|---|---|
| JP | 2013-096017 | 5/2013 |
| JP | 2013-227089 | 11/2013 |
| JP | 2013-227089 A | 11/2013 |

* cited by examiner

MEDIUM SUPPORTING UNIT AND RECORDING APPARATUS

BACKGROUND

1. Technical Field

The present invention relates to a medium supporting unit, a recording apparatus, and a medium supporting method.

2. Related Art

In the related art, a medium supporting unit, which includes a pressing portion capable of pressing a medium supported by a supporting portion, has been used. The medium is pressed by the pressing portion, thereby making it possible to set the medium by suppressing floating of the medium.

For example, JP-A-2013-227089 discloses a medium supporting unit which includes a set tray as a supporting portion and a frame as the pressing portion capable of performing pressing along the entire periphery of the edge parts of the set tray. Here, in the set tray of the medium supporting unit, an edge portion for accommodating the frame along the entire periphery of the edge parts is provided.

However, if the edge portion for accommodating the pressing portion along the entire periphery of the supporting portion is provided, even when the medium is set in the supporting portion by suppressing floating of the medium, for example, in a case in which a solid (intensely stiff) medium is used, a case in which the medium absorbs moisture in the air, a case in which the medium is turgid with attached ink, or the like, there is a concern that the medium will float if there is no region suppressing floating of the medium.

SUMMARY

An advantage of some aspects of the invention is to provide a medium supporting unit which includes a pressing portion capable of pressing a medium supported by a supporting portion, in which floating of the medium is suppressed.

A medium supporting unit of a first aspect of the invention includes a supporting portion that includes a first surface supporting a medium, a second surface which is recessed more than the first surface, and a first side surface which is a side surface positioned between the first surface and the second surface and connecting the first surface to the second surface, and a pressing portion that includes a pressing surface pressing the medium supported by the first surface at a position which faces the second surface, a facing side surface which faces the first side surface, in which in the supporting portion and the pressing portion, at the time of a holding state in which the medium is supported by the first surface and is pressed by the pressing surface, a part of the medium positioned between the first side surface and the facing side surface is capable of being held in a state of being separated from the second surface.

In the medium supporting unit of a second aspect of the invention, according to the first aspect, an interval between the first side surface and the facing side surface may be greater than an interval between the first surface and the second surface.

In the medium supporting unit of a third aspect of the invention, according to the first aspect or the second aspect, in the holding state, the area of a region of the second surface which does not face the pressing surface may be greater than the area of a region of the second surface which faces the pressing surface.

In the medium supporting unit of a fourth aspect of the invention, according to any one of the first aspect to the third aspect, the interval between the first side surface and the facing side surface in the holding state may be 3 mm or more.

A medium supporting unit of a fifth aspect of the invention includes a supporting portion that includes a first surface supporting a medium, a second surface recessed more than the first surface, and a first side surface which is a side surface positioned between the first surface and the second surface and connecting the first surface to the second surface, and a pressing portion that includes a pressing surface pressing the medium supported by the first surface at a position facing the second surface, and a facing side surface which faces the first side surface, in which, at the time of a holding state in which the medium is supported by the first surface and is pressed by the pressing surface, an interval between the first side surface and the facing side surface is 3 mm or more.

A medium supporting unit of a sixth aspect of the invention includes a supporting portion that includes a first surface supporting a medium, a second surface recessed more than the first surface, and a first side surface which is a side surface positioned between the first surface and the second surface and connecting the first surface to the second surface, and a pressing portion that includes a pressing surface pressing the medium supported by the first surface at a position facing the second surface, and a facing side surface which faces the first side surface, in which, at the time of a holding state in which the medium is supported by the first surface and is pressed by the pressing surface, an interval between the first side surface and the facing side surface is greater than a thickness of the medium assumed to be used.

A recording apparatus of a seventh aspect of the invention includes the medium supporting unit according to any one of the first aspect to the sixth aspect, and a recording portion that is capable of performing recording on the medium supported by the medium supporting unit.

A medium supporting method of a medium supporting unit of an eighth aspect of the invention, the unit including a supporting portion which includes a first surface supporting a medium, a second surface recessed more than the first surface, and a first side surface which is a side surface positioned between the first surface and the second surface and connecting the first surface to the second surface, and a pressing portion which includes a pressing surface pressing the medium supported by the first surface at a position facing the second surface, and a facing side surface which faces the first side surface, the method includes holding a part of the medium positioned between the first side surface and the facing side surface in a state of being separated from the second surface, at the time of a holding state in which the medium is supported by the first surface and is pressed by the pressing surface.

According to the above aspects of the invention, in the medium supporting unit which includes the pressing portion capable of pressing the medium supported by the supporting portion, floating of the medium can be suppressed.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, a medium supporting unit 2 according to an embodiment of the invention and a recording apparatus 1 including the medium supporting unit 2 according to the embodiment will be described with reference to attached drawings in detail.

First, an outline of the recording apparatus 1 of the embodiment will be described.

Figure 1:
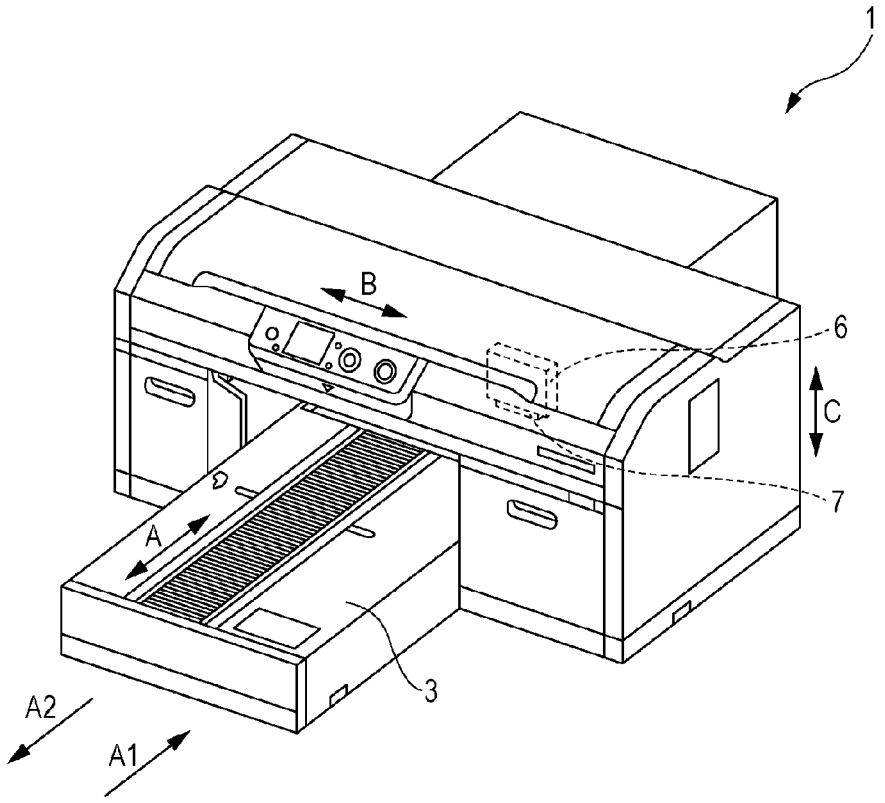
FIG. 1 is a schematic perspective view of a recording apparatus according to an embodiment of the invention.
Figure 2:
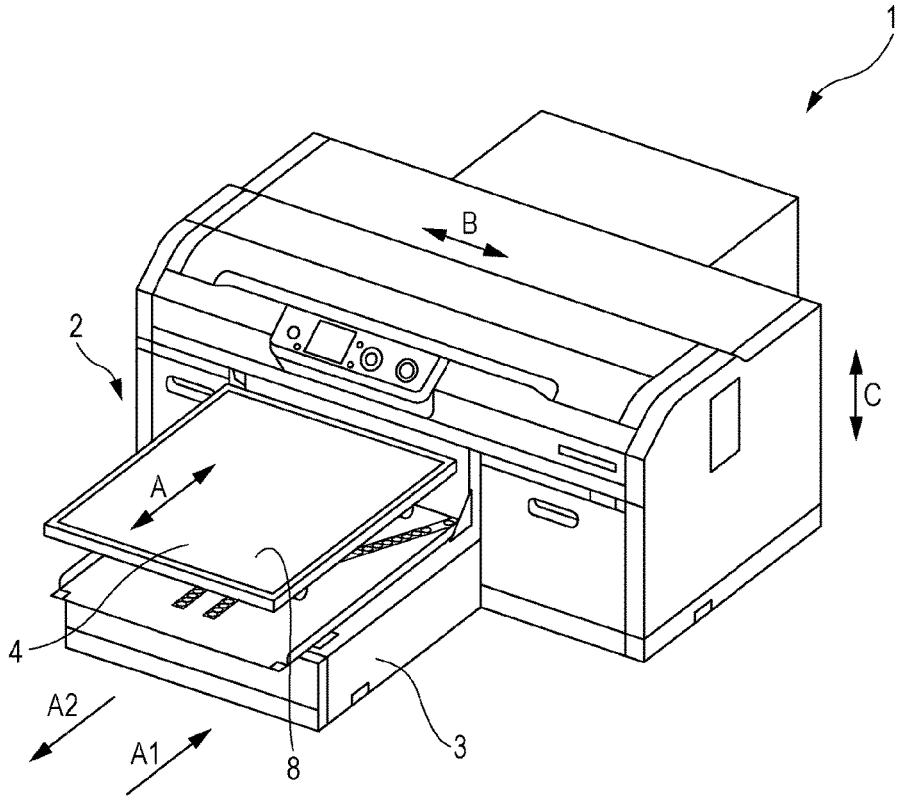
FIG. 2 is a schematic perspective view of the recording apparatus according to the embodiment of the invention.

FIG. 1 and FIG. 2 are schematic perspective views of the recording apparatus 1 according to the embodiment of the invention, and in both drawings, FIG. 1 illustrates a state in which a tray 4 as a supporting portion of a medium M of the recording apparatus 1 of the embodiment (refer to FIG. 4) is at a recording start position, and FIG. 2 illustrates a state in which the tray 4 is at a set position of the medium M.

Figure 3:
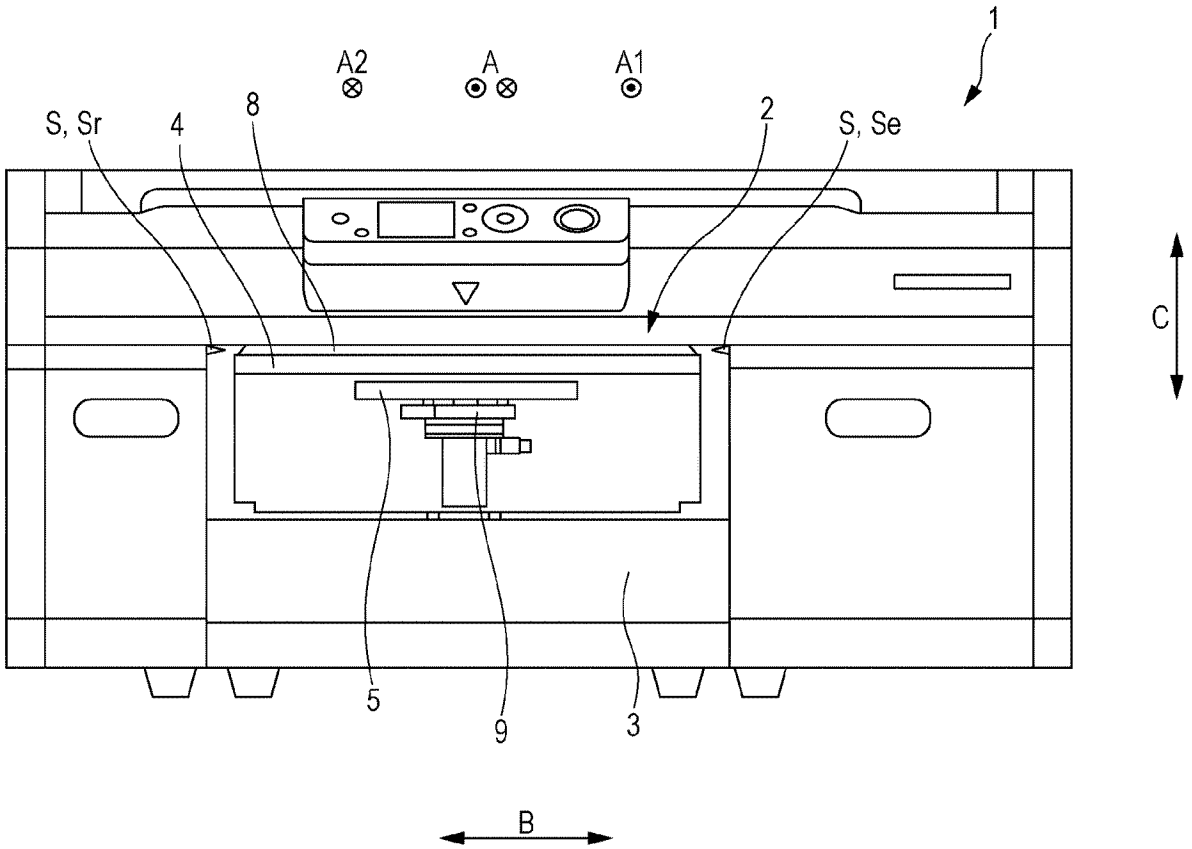
FIG. 3 is a schematic front view of the recording apparatus according to the embodiment of the invention.

In addition, FIG. 3 is a schematic front view of the recording apparatus 1 of the embodiment.

The recording apparatus 1 of the embodiment includes the medium supporting unit 2 which moves the medium M in a moving direction A in a state in which the medium M is supported by a first surface 8 of the tray 4. The medium supporting unit 2 includes the tray 4 which is a supporting portion of the medium M. The recording apparatus 1 includes a medium transporting portion 3 which transports the medium M supported by the tray 4 in the moving direction A. The moving direction A is a direction that includes a direction A1 and a direction A2 opposite to the direction A1. In addition, the tray 4 is mounted on a stage 5. The tray 4 is moved with the stage 5 in a height direction C by rotating a rotation lever 9. Moreover, as the medium M, various materials such as textile (fabric, fiber, or the like), paper, or vinyl chloride resin can be used.

In addition, a recording head 7, which can perform recording on the medium M by discharging ink, is provided inside a main body of the recording apparatus 1. In the embodiment, the recording head 7 corresponds to a recording portion which can perform recording on the medium M. Also, the recording head 7 is reciprocated in an intersecting direction B by reciprocating a carriage 6 provided with the recording head 7 in the intersecting direction B intersecting with the moving direction A, and thus the ink is discharged from the recording head 7 to the medium M supported by the tray 4, whereby the recording apparatus 1 of the embodiment forms a desired image.

Moreover, in the recording apparatus 1 of the embodiment, a front side (left lower direction) in FIG. 1 and FIG. 2 is a set position of the medium M with respect to the tray 4 (corresponding to FIG. 2). Also, after moving the tray 4 to which the medium M is set in the direction A1 of the moving direction A to a recording start position of a rear side (right upper direction) in FIG. 1 and FIG. 2 (corresponding to FIG. 1), recording is performed while moving the tray 4 in the direction A2 of the moving direction A.

The recording apparatus 1 of the embodiment includes the recording head 7 which performs recording while being reciprocated in the intersecting direction B; however, a recording apparatus, which includes a so-called line head in which a plurality of nozzles discharging the ink are provided in the intersecting direction B intersecting with the moving direction A, may be used.

Here, the "line head" is a recording head used in the recording apparatus in which a region of the nozzles formed in the intersecting direction B intersecting with the moving direction A of the medium M is provided so as to be capable of covering the entire intersecting direction B of the medium M, and the recording apparatus forms the image by relatively moving the recording head or the medium M. Moreover, the region of the nozzles of the intersecting direction B of the line head may not cover the entire intersecting direction B of all of medium M to which the recording apparatus corresponds.

In addition, the recording head 7 of the embodiment is a recording portion which can perform recording on the medium M by discharging the ink thereto; however, it is not limited to this recording portion, and for example, a transfer type recording portion which performs recording by transferring color materials to the medium M may be used.

In addition, as illustrated in FIG. 3, the recording apparatus 1 of the embodiment is provided with a sensor S and is configured to be capable of detecting whether or not an abnormality (the width of an interval between the medium M and the recording head 7 being too narrow) of an interval between the medium M supported by the tray 4 and the recording head 7 exists.

Here, the sensor S includes a light emission portion Se and a light receiving portion Sr. Also, the sensor S applies light from the light emission portion Se to the light receiving portion Sr and detects whether or not the abnormality of the interval exists based on whether or not the light receiving portion Sr receives the light. However, it is not limited to such a configuration.

Next, the medium supporting unit 2 of the embodiment of the invention will be described in detail.

Figure 4:
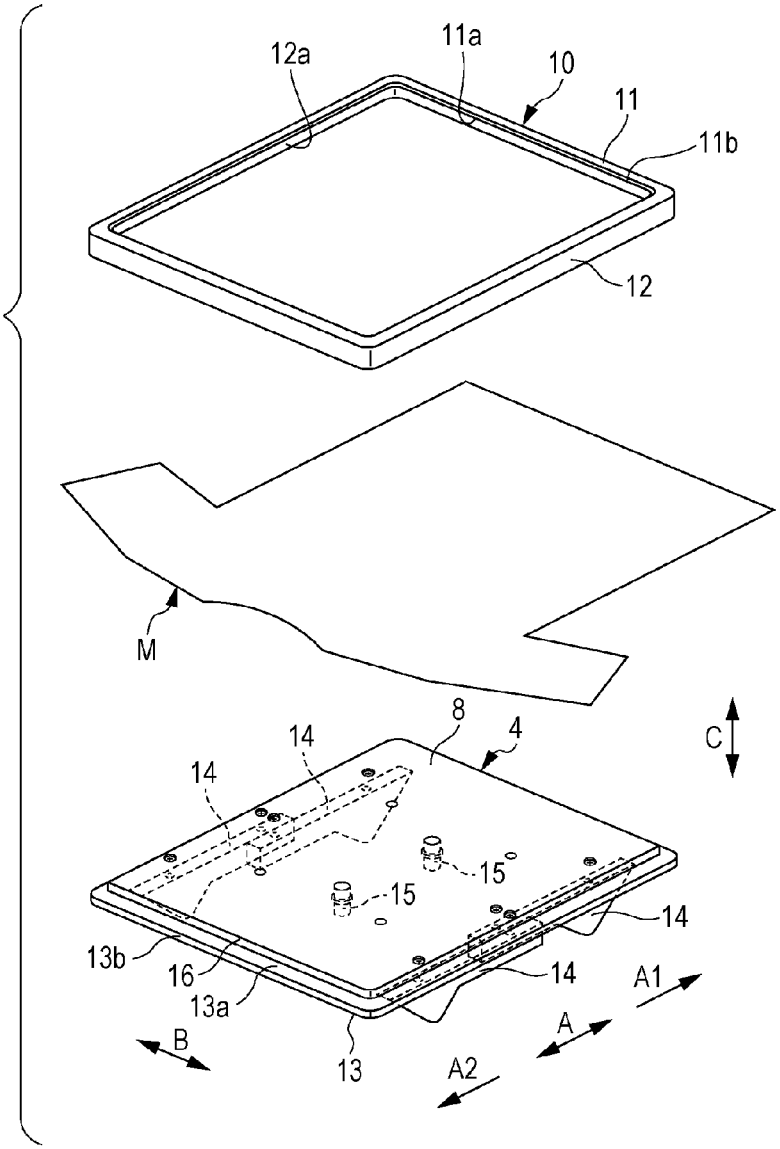
FIG. 4 is a schematic perspective view illustrating a medium supporting unit according to the embodiment of the invention.
Figure 5A:
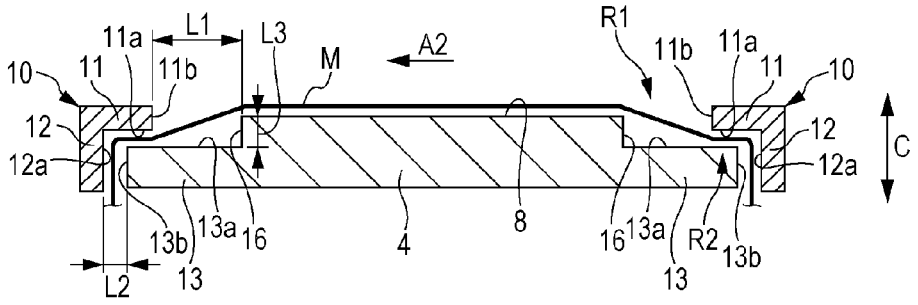
FIGS. 5A and 5B are schematic side sectional views illustrating the medium supporting unit according to the embodiment of the invention.
Figure 5B:
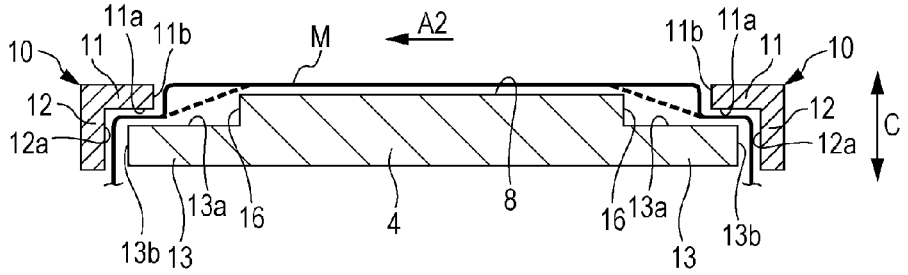

Here, FIG. 4 is a schematic perspective view illustrating the medium supporting unit 2 of the embodiment. FIGS. 5A and 5B are schematic side sectional views illustrating the medium supporting unit 2 of the embodiment. In addition, FIG. 6 is a schematic plan view illustrating the medium supporting unit 2 of the embodiment.

Figure 7:
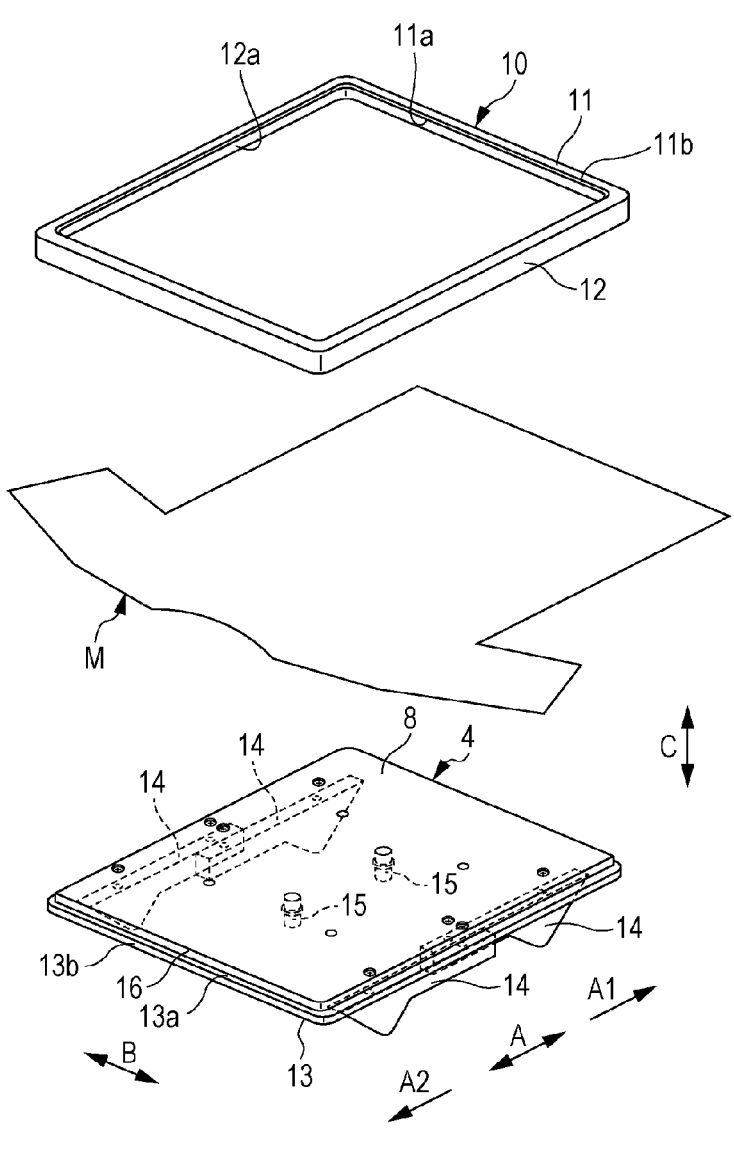
FIG. 7 is a schematic perspective view illustrating a medium supporting unit of the related art.
Figure 8A:
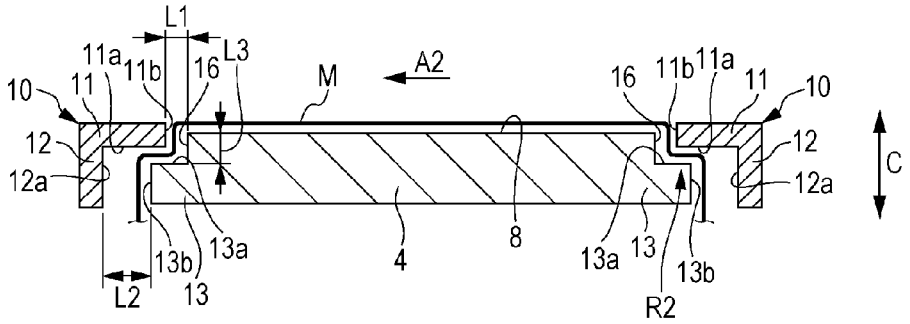
FIGS. 8A and 8B are schematic side sectional views illustrating the medium supporting unit of the related art.
Figure 8B:
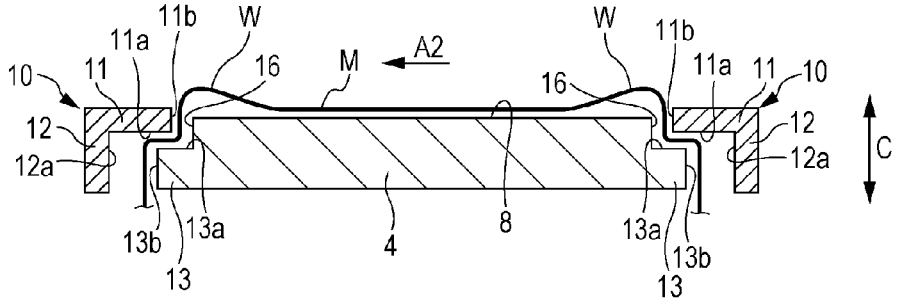

Meanwhile, FIG. 7 is a schematic perspective view illustrating a medium supporting unit of the related art and is a view corresponding to FIG. 4 illustrating the medium supporting unit 2 of the embodiment. In addition, FIGS. 8A and 8B are schematic side sectional views illustrating a medium supporting unit of the related art and are views corresponding to FIGS. 5A and 5B illustrating the medium supporting unit 2 of the embodiment.

Figure 6:
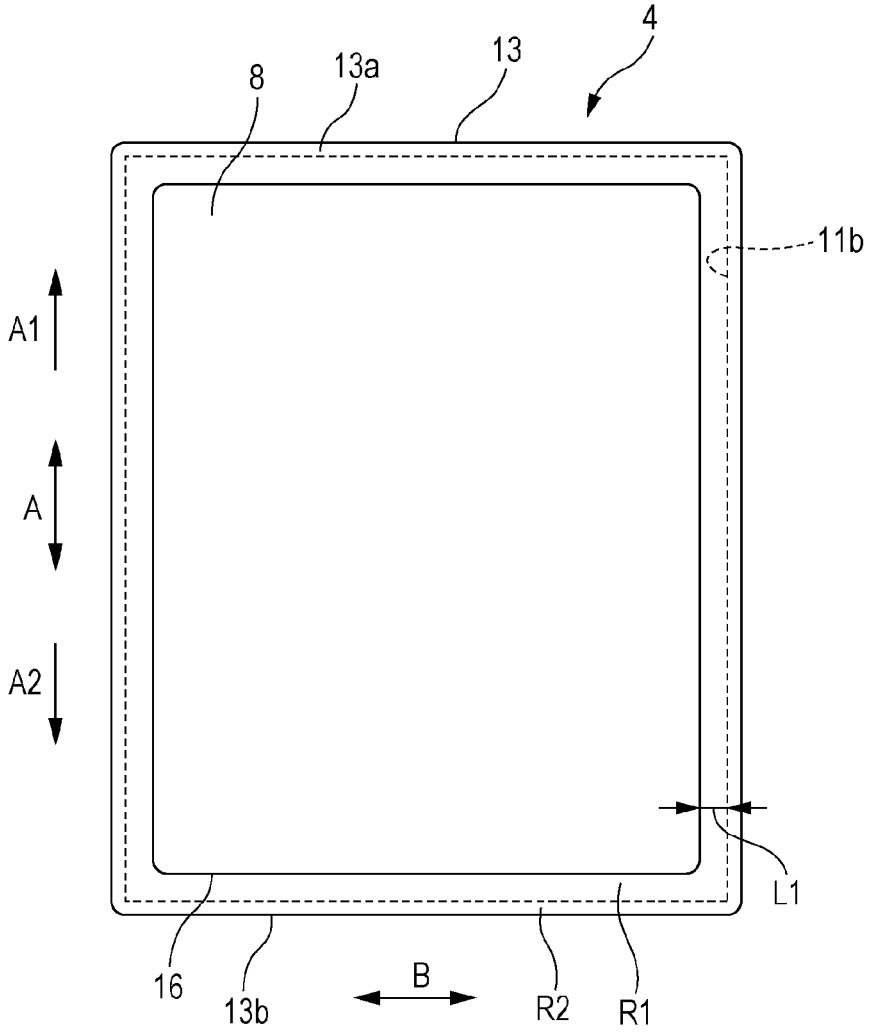
FIG. 6 is a schematic plan view illustrating the medium supporting unit according to the embodiment of the invention.

As illustrated in FIG. 4 to FIG. 6, the medium supporting unit 2 of the embodiment is provided with the tray 4 as the supporting portion which includes a first surface 8 supporting the medium M, a second surface 13*a* formed on an edge portion 13, which is recessed more than the first surface 8, and a first side surface 16 which is a side surface connecting the first surface 8 to the second surface 13*a* and is positioned between the first surface 8 and the second surface 13*a*. In addition, a frame shaped pressing portion 10 is also provided, and the pressing portion 10 includes a pressing surface 11*a* pressing the medium M supported by the first surface 8, which is a lower surface of an eaves portion 11, at a position facing the second surface 13*a*, and a facing side surface 11*b* facing the first side surface 16 which is the side surface of the eaves portion 11.

In the tray 4, the first surface 8 is a part which supports a region of the medium M on which the recording is performed, and the second surface 13*a* is a part which supports the pressing portion 10. The first side surface 16 is a surface positioned between the first surface 8 and the second surface 13*a*. The first surface 8, the second surface 13*a*, and the first side surface 16 may be a plane surface or may be a curved surface, when parts have the same functions as those of the parts described above. In addition, the first surface 8, the second surface 13*a*, and the first side surface 16 may not necessarily be surfaces. That is, the tray 4 may be configured to have a first part (correspond to first surface 8) supporting a region of the medium M on which the recording is performed, a second part (correspond to second surface 13*a*) supporting the pressing portion 10, and an intermediate part (correspond to first side surface 16) positioned between the first part and the second part. In addition, even in the facing side surface 11*b* of the pressing portion 10, a part may be used when a part has a function of facing the intermediate part positioned between the first part and the second part. The facing side surface 11*b* may be a plane surface or may be a curved surface, and may be a facing part which is not a surface.

Also, the tray 4 and the pressing portion 10 are configured so as to be capable of holding a part of the medium M positioned between the first side surface 16 and the facing side surface 11*b* in a state of being separated from the second surface 13*a* at the time of a holding state in which the medium M is supported by the first surface 8 and is pressed by the pressing surface 11*a* (pinched between second surface 13*a* and pressing surface 11*a*). That is, the part in the medium M positioned between the first side surface 16 and the facing side surface 11*b* is configured so as to be capable of being held in a state of being separated from the second surface 13*a*.

In other words, an interval L1 (refer to FIG. 5A) between the first side surface 16 and the facing side surface 11*b* in the holding state is formed to be greater than the thickness (a thickness of a medium M having the greatest thickness among the mediums M assumed to be used) of the medium M assumed to be used.

That is, the tray 4 and the pressing portion 10 are configured to have a sufficient interval L1 between a step part (first side surface 16), which is between the first surface 8 and the second surface 13*a*, and a pinched part (facing side surface 11*b*) of the medium formed by the second surface 13*a* and the pressing surface 11*a*. By providing a sufficient interval L1, for example, in a case in which a solid (intensely stiff) medium M is used, a case in which the medium M is turgid, or the like, a region R1 (the region R1 in the second surface 13*a* not facing the pressing surface 11*a*) suppressing floating of the medium M can be sufficient. The region R1 functions as a buffer region where the medium M can be held in a loose state (protruding state toward rear surface side) or in a wrinkled state (protruding state toward front surface side). Since the part of the medium M positioned at the region R1 is lower than the first surface 8, even when the medium M is deformed, it is less likely that the part of the medium M will have a floating portion W with respect to the first surface 8. That is, by providing the region R1, a space capable of preventing loosening or wrinkling of the medium M can be provided at a position lower than the first surface 8. For this reason, the medium supporting unit 2 of the embodiment can suppress the floating portion W of the medium M, and the recording apparatus 1 of the embodiment can perform recording by suppressing the floating portion W of the medium M.

In addition, in other words, at the time of the holding state in which the medium M is supported by the first surface 8 and is pressed by the pressing surface 11*a* when the medium supporting unit 2 of the embodiment is used, the part of the medium M positioned between the first side surface 16 and the facing side surface 11*b* can be held in a state of being separated from the second surface 13*a*. In this way, by providing a sufficient interval L1 between the first side surface 16 and the facing side surface 11*b*, for example, in a case in which the solid (intensely stiff) medium M is used, a case in which the medium M is turgid, or the like, the region suppressing floating of the medium M can be sufficient.

Here, in the medium supporting unit 2 of the embodiment, each of FIGS. 5A and 5B respectively illustrates a state (a state in which the medium M is set on the tray 4) illustrated in FIG. 4, and a state in which the pressing portion 10 is combined with respect to the tray 4 to which the medium M is mounted. In one of these, FIG. 5A illustrates a case in which the soft (weakly stiff) medium M is used, and FIG. 5B illustrates a case in which the solid (intensely stiff) medium M is used.

Meanwhile, FIGS. 8A and 8B respectively illustrate a state (a state in which the medium M is set on the tray 4) illustrated in FIG. 7 and a state in which the pressing portion 10 is combined with respect to the tray 4 to which the medium M is mounted in a medium supporting unit of the related art. FIG. 8A illustrates a case in which the soft (weakly stiff) medium M is used, and FIG. 8B illustrates a case in which the solid (intensely stiff) medium M is used.

The medium supporting unit 2 of the embodiment has a large interval L1 between the first side surface 16 and the facing side surface 11*b*, and a small interval L2 between a side surface 12*a* of a wall portion 12 of the pressing portion 10 and a side surface 13*b* of the edge portion 13. Also, the medium M is held by pinching the medium M between the side surface 12*a* and the side surface 13*b*, instead of between the first side surface 16 and the facing side surface 11*b*. With such a configuration, by curling the medium M so as not to float in the region R1, as well as the case in which the soft (weakly stiff) medium M is used as illustrated in FIG. 5A, even in a case in which the solid (intensely stiff) medium M is used as illustrated in FIG. 5B, the medium M can be held in a state in which floating portion W is barely generated.

Meanwhile, the medium supporting unit of the related art has a small interval L1 between the first side surface 16 and the facing side surface 11*b* and a large interval L2 between the side surface 12*a* of the wall portion 12 of the pressing portion 10 and the side surface 13*b* of the edge portion 13. Also, the medium M is held by pinching the medium M between the first side surface 16 and the facing side surface 11*b*. For this reason, as illustrated in FIG. 8A, in a case in which the soft (weakly stiff) medium M is used, the medium M can be held in a state in which the floating portion W is barely generated. However, as illustrated in FIG. 8B, in a case in which the solid (intensely stiff) medium M is used, without the region R1, there is a case in which a relatively large floating portion W is generated.

Moreover, in the above description, the case in which the soft (weakly stiff) medium M is used is illustrated with reference to FIG. 5A and FIG. 8A, and the case in which the solid (intensely stiff) medium M is used is illustrated with reference to FIG. 5B and FIG. 8B. However, when the medium M is turgid in the state respectively illustrated in each of FIG. 5A and FIG. 8A, the medium M achieves the state illustrated in each of FIG. 5B and FIG. 8B, respectively. That is, as illustrated in FIG. 8B, there is a case in which the medium supporting unit of the related art cannot hold the medium M without generating the floating portion W if the medium M is turgid. Meanwhile, as illustrated in FIG. 5B, the medium supporting unit 2 of the embodiment can hold the medium M in a state in which the floating portion W is barely generated even when the medium M is turgid.

Here, as described above, the medium supporting unit 2 of the embodiment is configured to have a small interval L2. For this reason, when a procedure is performed from the state illustrated in FIG. 4 to a state in which the pressing portion 10 is combined with respect to the tray 4 to which the medium M is mounted, the medium M is pinched and pulled downward in the interval L2 because the interval L1 is large and the interval L2 is small. As seen from the above, when the medium M is pulled downward in the interval L2, the medium M on the first surface 8 is pulled from the periphery thereof, and floating of the medium M on the first surface 8 is reduced. However, such a configuration is not limited to a configuration in which the interval L2 is small.

In addition, the medium supporting unit 2 of the embodiment is configured to have the interval L1 between the first side surface 16 and the facing side surface 11*b* greater than an interval L3 between the first surface 8 and the second surface 13*a*. With such a configuration, the tray 4 and the pressing portion 10 have an interval L1 between the first side surface 16 and the facing side surface 11*b* which is greater than the interval L3 between the first surface 8 and the second surface 13*a*, that is, it is configured to be sufficient, thereby suppressing the floating portion W of the medium M.

Here, the interval L3 between the first surface 8 and the second surface 13*a* is an interval in the height direction C (supporting direction of medium M).

In addition, as illustrated in FIG. 6, the medium supporting unit 2 of the embodiment has a configuration in which, in the holding state in which the medium M is supported by the first surface 8 and pressed by the pressing surface 11*a*, the area of the region R1 (a region inside a broken line corresponding to a position of the facing side surface 11*b* in the second surface 13*a*) not facing the pressing surface 11*a* in the second surface 13*a* is greater than the area of the region R2 (a region outside the broken line corresponding to the position of the facing side surface 11*b* in the second surface 13*a*) facing the pressing surface 11*a* in the second surface 13*a*. That is, in the second surface 13*a*, for example, in a case in which the solid (intensely stiff) medium M is used, a case in which the medium M is turgid, or the like, the region R1 is taken sufficiently so as to be capable of not floating the medium M.

Moreover, in the medium supporting unit 2 of the embodiment, the interval L1 between the first side surface 16 and the facing side surface 11*b* is 8 mm, the interval L2 between the side surface 12*a* and the side surface 13*b* is 1.1 mm, and the interval L3 between the first surface 8 and the second surface 13*a* is 4 mm.

Particularly, the intervals are not limited to these intervals; however, it is preferable that the interval L1 between the first side surface 16 and the facing side surface 11*b* is 3 mm or more. By making the interval L1 be 3 mm or more, the interval L1 has a sufficient distance, for example, even in the case in which the solid (intensely stiff) medium M is used, the case in which the medium M is turgid, or the like, the region R1 capable of not floating the medium M can be taken sufficiently. An example of the medium M includes textile; however, if the interval L1 is 3 mm or more, it is sufficient distance for a textile having a general thickness such as one used for clothing.

Moreover, as illustrated in FIG. 4, the tray 4 of the embodiment is provided with a mounting portion 14 when mounted on a plate, or the like, removed from the stage 5, and a position determining portion 15 which can determine a position with respect to the stage 5. However, a configuration of the tray 4 is not particularly limited.

Moreover, the invention is not limited to this embodiment, and can be formed variously within the range of the invention disclosed in Claims, and thus, resultants therefrom are included in the range of the invention.

Hitherto, the invention is described based on specific embodiments. Here, the invention is arranged and described again.

The medium supporting unit 2 of the first aspect of the invention includes the supporting portion 4 that includes the first surface 8 supporting the medium M, the second surface 13*a* recessed more than the first surface 8, and the first side surface 16 which is a side surface positioned between the first surface 8 and the second surface 13*a* and connecting the first surface 8 to the second surface 13*a*, and the pressing portion 10 that includes the pressing surface 11*a* pressing the medium M supported by the first surface 8 at a position facing the second surface 13*a*, and the facing side surface 11*b* facing the first side surface 16, in which in the supporting portion 4 and the pressing portion 10, at the time of the holding state in which the medium M is supported by the first surface 8 and is pressed by the pressing surface 11*a*, a part of the medium M positioned between the first side surface 16 and the facing side surface 11*b* is capable of being held in a state of being separated from the second surface 13*a*.

According to the aspect, in the supporting portion 4 and the pressing portion 10, at the time of the holding state, the part of the medium M positioned between the first side surface 16 and the facing side surface 11*b* can be held in a state of being separated from the second surface 13*a*. That is, the supporting portion 4 and the pressing portion 10 have the interval L1 between the first side surface 16 and the facing side surface 11*b* sufficiently. By taking the interval L1 sufficiently, for example, in the case in which the solid (intensely stiff) medium M is used, the case in which the medium M is turgid, or the like, the region R1 can be taken sufficiently so that the medium M does note float. For this reason, the floating of the medium M can be suppressed.

In the medium supporting unit 2 of the second aspect of the invention according to the first aspect, the interval L1 between the first side surface 16 and the facing side surface 11*b* is greater than the interval L3 between the first surface 8 and the second surface 13*a*.

According to the aspect, the interval L1 between the first side surface 16 and the facing side surface 11*b* is greater than the interval L3 between the first surface 8 and the second surface 13*a*. That is, the supporting portion 4 and the pressing portion 10 have the interval L1 between the first side surface 16 and the facing side surface 11*b* greater than the interval L3 between the first surface 8 and the second surface 13*a*, that is, the intervals are taken sufficiently. For this reason, the floating of the medium M can be suppressed.

In the medium supporting unit 2 of the third aspect of the invention according to the first aspect or the second aspect, in the holding state, the area of the region R1 in the second surface 13*a* not facing the pressing surface 11*a* is greater than the area of the region R2 in the second surface 13*a* facing the pressing surface 11*a*.

According to the aspect, in the holding state, the area of the region R1 in the second surface 13*a* not facing the pressing surface 11*a* is greater than the area of the region R2 in the second surface 13*a* facing the pressing surface 11*a*. That is, in the second surface 13*a*, for example, in the case in which the solid (intensely stiff) medium M is used, the case in which the medium M is turgid, or the like, the region R1 (the region R1 in the second surface 13*a* not facing the pressing surface 11*a*) capable of not floating the medium M can be taken sufficiently.

In the medium supporting unit 2 of the fourth aspect of the invention according to any one of the first aspect to the third aspect, the interval L1 between the first side surface 16 and the facing side surface 11*b* in the holding state is 3 mm or more.

According to the aspect, the interval L1 between the first side surface 16 and the facing side surface 11*b* in the holding state is 3 mm or more. That is, the interval L1 between the first side surface 16 and the facing side surface 11*b* of the supporting portion 4 and the pressing portion 10 is sufficient. By making the interval L1 be 3 mm or more, for example, in the case in which the solid (intensely stiff) medium M is used, the case in which the medium M is turgid, or the like, the region R1 capable of not floating the medium M can be taken sufficiently.

The medium supporting unit 2 of the fifth aspect of the invention includes the supporting portion 4 that includes the first surface 8 supporting the medium M, the second surface 13*a* recessed more than the first surface 8, and a first side surface 16 which is a side surface positioned between the first surface 8 and the second surface 13*a* and connecting the first surface 8 to the second surface 13*a*, and the pressing portion 10 that includes a pressing surface 11*a* pressing the medium M supported by the first surface 8 at a position facing the second surface 13*a*, and the facing side surface 11*b* facing the first side surface 16, in which, at the time of the holding state in which the medium M is supported by the first surface 8 and is pressed by the pressing surface 11*a*, the interval L1 between the first side surface 16 and the facing side surface 11*b* is 3 mm or more.

According to the aspect, the interval L1 between the first side surface 16 and the facing side surface 11*b* in the holding state is 3 mm or more. That is, the supporting portion 4 and the pressing portion 10 have the interval L1 between the first side surface 16 and the facing side surface 11*b* sufficiently. By making the interval L1 be 3 mm or more, for example, in the case in which the solid (intensely stiff) medium M is used, the case in which the medium M is turgid, or the like, the region R1 capable of not floating the medium M can be taken sufficiently.

The medium supporting unit 2 of the sixth aspect of the invention includes the supporting portion 4 that includes the first surface 8 supporting the medium M, the second surface 13*a* recessed more than the first surface 8, and a first side surface 16 which is a side surface positioned between the first surface 8 and the second surface 13*a* and connecting the first surface 8 to the second surface 13*a*, and the pressing portion 10 that includes a pressing surface 11*a* pressing the medium M supported by the first surface 8 at a position facing the second surface 13*a*, and the facing side surface 11*b* facing the first side surface 16, in which, at the time of the holding state in which the medium M is supported by the first surface 8 and is pressed by the pressing surface 11*a*, the interval L1 between the first side surface 16 and the facing side surface 11*b* is greater than the thickness of the medium M assumed to be used.

Here, the thickness of the medium M assumed to be used means a medium M having the greatest thickness among the media M assumed to be used.

According to the aspect, the interval L1 between the first side surface 16 and the facing side surface 11*b* in the holding state is greater than the thickness of the medium M assumed to be used. That is, the supporting portion 4 and the pressing portion 10 have the interval L1 between the first side surface 16 and the facing side surface 11*b* sufficiently. By making the interval L1 be greater than the thickness of the medium M assumed to be used, for example, in the case in which the solid (intensely stiff) medium M is used, the case in which the medium M is turgid, or the like, the region capable of not floating the medium M can be taken sufficiently.

The recording apparatus 1 of the seventh aspect of the invention includes the medium supporting unit 2 according to any one of the first aspect to the sixth aspect, and a recording portion 7 that is capable of performing recording on the medium M supported by the medium supporting unit 2.

According to the aspect, recording can be performed by suppressing the floating portion W of the medium M.

The medium supporting method of the medium supporting unit 2 of the eighth aspect of the invention, the unit including the supporting portion 4 which includes the first surface 8 supporting the medium M, the second surface 13*a* recessed more than the first surface 8, and the first side surface 16 which is a side surface positioned between the first surface 8 and the second surface 13*a* and connecting the first surface 8 to the second surface 13*a*, and the pressing portion 10 which includes the pressing surface 11*a* pressing the medium M supported by the first surface 8 at a position facing the second surface 13*a*, and the facing side surface 11*b* facing the first side surface 16, the method includes holding the part of the medium M positioned between the first side surface 16 and the facing side surface 11*b* in a state of being separated from the second surface 13*a*, at the time of the holding state in which the medium M is supported by the first surface 8 and is pressed by the pressing surface 11*a*.

According to the aspect, when the medium M is in the holding state, a part of the medium M positioned between the first side surface 16 and the facing side surface 11*b* can be held in a state of being separated from the second surface 13*a*. That is, the interval L1 between the first side surface 16 and the facing side surface 11*b* is taken sufficiently. By taking the interval L1 sufficiently, for example, in the case in which the solid (intensely stiff) medium M is used, the case in which the medium M is turgid, or the like, the region R1 capable of not floating the medium M can be taken sufficiently.

The entire disclosure of Japanese Patent Application No. 2015-032782, filed Feb. 23, 2015 is expressly incorporated reference herein.

What is claimed is:

1. A medium supporting unit comprising:

a supporting portion that includes a first surface supporting a medium, a second surface recessed more than the first surface, and a first side surface which is a side surface positioned between the first surface and the second surface and connecting the first surface to the second surface; and a pressing portion that includes a pressing surface pressing the medium supported by the first surface at a position facing the second surface, and a facing side surface which faces the first side surface, wherein in the supporting portion and the pressing portion, at the time of a holding state in which the medium is supported by the first surface and is pressed by the pressing surface, a part of the medium positioned between the first side surface while being separated from the first side surface and the facing side surface is capable of being held in a state of being separated from the second surface.

2. The medium supporting unit according to claim 1, wherein an interval between the first side surface and the facing side surface is greater than an interval between the first surface and the second surface.

3. The medium supporting unit according to claim 1, wherein in the holding state, an area of a region of the second surface not facing the pressing surface is greater than an area of a region of the second surface which faces the pressing surface.

4. The medium supporting unit according to claim 1, wherein the interval between the first side surface and the facing side surface in the holding state is 3 mm or more.

5. A medium supporting unit comprising:

a supporting portion that includes a first surface supporting a medium, a second surface recessed more than the first surface, and a first side surface which is a side surface positioned between the first surface and the second surface and connecting the first surface to the second surface; and a pressing portion that includes a pressing surface pressing the medium supported by the first surface at a position facing the second surface, and a facing side surface which faces the first side surface, wherein at the time of a holding state in which the medium is supported by the first surface and is pressed by the pressing surface, an interval between the first side surface and the facing side surface is 3 mm or more, wherein the medium is separated from the first side surface in the interval.

6. A medium supporting unit comprising:

a supporting portion that includes a first surface supporting a medium, a second surface recessed more than the first surface, and a first side surface which is a side surface positioned between the first surface and the second surface and connecting the first surface to the second surface; and a pressing portion that includes a pressing surface pressing the medium supported by the first surface at a position facing the second surface, and a facing side surface which faces the first side surface, wherein at the time of a holding state in which the medium is supported by the first surface and is pressed by the pressing surface, an interval between the first side surface and the facing side surface is greater than a thickness of the medium assumed to be used, wherein the medium is separated from the first side surface in the interval.

7. A recording apparatus comprising:

the medium supporting unit according to claim 1; and a recording portion that is capable of performing recording on the medium supported by the medium supporting unit.

8. A recording apparatus comprising:

the medium supporting unit according to claim 2; and a recording portion that is capable of performing recording on the medium supported by the medium supporting unit.

9. A recording apparatus comprising:

the medium supporting unit according to claim 3; and a recording portion that is capable of performing recording on the medium supported by the medium supporting unit.

10. A recording apparatus comprising:

the medium supporting unit according to claim 4; and a recording portion that is capable of performing recording on the medium supported by the medium supporting unit.

11. A recording apparatus comprising:

the medium supporting unit according to claim 5; and a recording portion that is capable of performing recording on the medium supported by the medium supporting unit.

12. A recording apparatus comprising:

supporting unit according to claim 6; and a recording portion that is capable of performing recording on the medium supported by the medium supporting unit.

* * * * *